US007261181B2

(12) United States Patent
Sellers, II et al.

(10) Patent No.: US 7,261,181 B2
(45) Date of Patent: Aug. 28, 2007

(54) DETATCHABLE MUFFLER APPARATUS FOR PNEUMATIC TOOLS

(75) Inventors: Orlando Sellers, II, Peoria, IL (US); Charles Steven Chapman, Eureka, IL (US)

(73) Assignee: Caterpillar Inc., Peoria, IL (US)

( * ) Notice: Subject to any disclaimer, the term of this patent is extended or adjusted under 35 U.S.C. 154(b) by 288 days.

(21) Appl. No.: 10/860,170

(22) Filed: Jun. 3, 2004

(65) Prior Publication Data

US 2005/0269152 A1 Dec. 8, 2005

(51) Int. Cl.
*B12J 1/00* (2006.01)
*F01N 1/00* (2006.01)

(52) U.S. Cl. ..... 181/230; 181/241; 181/252; 181/256; 181/217; 181/222

(58) Field of Classification Search ..... 181/230, 181/205, 252, 256, 222, 217; 173/DIG. 2, 173/169

See application file for complete search history.

(56) References Cited

U.S. PATENT DOCUMENTS

| | | | | |
|---|---|---|---|---|
| 3,323,615 | A * | 6/1967 | Kessler | 181/230 |
| 4,113,052 | A | 9/1978 | McElroy, Jr. | |
| 4,205,732 | A * | 6/1980 | Auerbach et al. | 181/230 |
| 4,316,523 | A * | 2/1982 | Boretti | 181/226 |
| 4,404,799 | A | 9/1983 | Dudek | |
| 4,530,418 | A * | 7/1985 | Currie | 181/227 |
| 4,558,763 | A | 12/1985 | Montabert | |
| 4,778,015 | A * | 10/1988 | Jacobsson | 173/169 |
| 5,189,267 | A | 2/1993 | Ligman | |
| 5,432,307 | A | 7/1995 | Maurer | |
| 5,500,494 | A * | 3/1996 | Ligman | 181/230 |
| 5,581,055 | A | 12/1996 | Self et al. | |
| 5,952,623 | A | 9/1999 | Sterling | |
| 6,089,346 | A * | 7/2000 | Tredinnick et al. | 181/230 |
| 6,202,785 | B1 * | 3/2001 | Hilling et al. | 181/230 |
| 6,209,678 | B1 | 4/2001 | Sterling | |
| 6,923,272 | B2 * | 8/2005 | Jansson et al. | 173/169 |
| 2004/0177980 | A1 * | 9/2004 | Lucas | 173/169 |

* cited by examiner

*Primary Examiner*—Lincoln Donovan
*Assistant Examiner*—Forrest Phillips
(74) *Attorney, Agent, or Firm*—Liell & McNeil

(57) ABSTRACT

The exhaust created from the operation of pneumatic tools can create a considerable amount of noise. The present disclosure includes a detachable muffler apparatus used to reduce the sound during the operation of a pneumatic tool. The muffler apparatus includes a flexible outer housing that defines a muffler passage extending between a muffler inlet and a muffler outlet. The flexible outer housing includes an attachment end that defines the muffler inlet and a distal end that defines the muffler outlet. The attachment end can be removably attached to a pneumatic tool body by a fastener. Tool exhaust is forced through and around folds within at least one sheet of permeable material positioned within the muffler passage.

14 Claims, 3 Drawing Sheets

DETATCHABLE MUFFLER APPARATUS FOR PNEUMATIC TOOLS

TECHNICAL FIELD

The present disclosure relates generally to muffler apparatuses, and more specifically to a detachable muffler apparatus used to reduce sound during operation of a pneumatic tool.

BACKGROUND

A considerable amount of noise and particulate debris can be generated from exhaust ports of various pneumatic tools, such as wrenches, drills, and grinders. Over the years, there has been various attempts at muffling the noise generated from the exhaust and venting the particulate away from a tool operator. For instance, a pneumatic hand tool exhaust muffler described in U.S. Pat. No. 6,209,678 B1, issued to Sterling, on Apr. 3, 2001, is attached to or positioned within an exhaust passage defined by a handle of the pneumatic tool. The muffler is either integrated into the handle of the pneumatic tool, or requires a pneumatic tool with an exhaust port of a specific size for mating with the muffler. Thus, the muffler must be specific for a certain type and size of pneumatic tool, and may not be removed from the pneumatic tool handle after manufacturing.

Moreover, the Sterling muffler includes an outer housing in which a plurality of separate dividers are positioned about an inner tube having a plurality of holes and a cutoff wall. During operation of the pneumatic tool, exhaust can flow into the muffler via an inlet of the inner tube, and out of the inner tube through the plurality of holes upstream from the cutoff wall. The exhaust then can flow around and/or through the dividers, back into the inner tube through the holes downstream from the cutoff wall, and out the muffler via an outlet. The tortuous exhaust flow path, including the path through and around the dividers, slows the flow of exhaust, thereby muffling the exhaust noise. Supposedly, the more tortuous the flow path, the greater the reduction in sound. However, excessive slowing of the exhaust flow can produce a back pressure within the pneumatic tool that adversely affects the operating power of the tool. The Sterling muffler does not include an adjustment feature that allows the operator to adjust the exhaust path in order to achieve the greatest reduction in sound without decreasing the tool's operating power.

The present disclosure is directed at overcoming one or more of the problems set forth above.

SUMMARY OF THE DISCLOSURE

In one aspect of the present disclosure, a muffler apparatus includes a flexible outer housing that defines at least one muffler passage that extends between a muffler inlet and a muffler outlet. The muffler inlet and the muffler outlet are defined by an attachment end and a distal end of the outer housing, respectively. At least one sheet of permeable material includes a plurality of folds and is positioned within the muffler passage. The attachment end of the outer housing can be attached to a body of a pneumatic tool by a fastener.

In another aspect of the present disclosure, a pneumatic tool includes a detachable muffler apparatus that includes a flexible outer housing with an attachment end defining a muffler inlet and a distal end defining a muffler outlet. The attachment end is removably attached to a tool body, and connects an exhaust port defined by the tool body with the muffler inlet. At least one sheet of permeable material with a plurality of folds is positioned within a muffler passage that extends between the muffler inlet and the muffler outlet.

In yet another aspect of the present disclosure, sound produced during operation of a pneumatic tool is reduced by removably attaching a muffler apparatus to a pneumatic tool body. Tool exhaust is passed through a muffler passage within the muffler apparatus. The muffler passage is partially obstructed with at least one sheet of permeable material.

DETAILED DESCRIPTION

Figure 1:
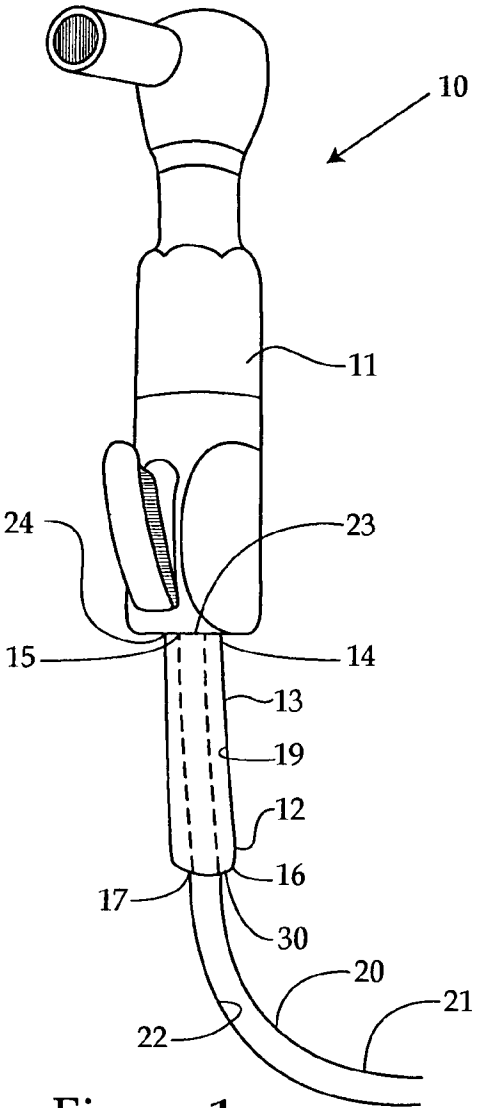
FIG. 1 is a side diagrammatic view of a pneumatic tool, according to the present disclosure.

Referring to FIG. 1, there is shown a side diagrammatic representation of a pneumatic tool 10, according to the present disclosure. Although the pneumatic tool 10 is illustrated as a pneumatic wrench, it should be appreciated that the present disclosure contemplates various types of pneumatic tools, including, but not limited to, pneumatic hammers, nail guns, grinders, planers, shapers, ratchets, and sanders. The present disclosure also contemplates use with pneumatically exhausted surgical, dental or other medical devices. The pneumatic tool 10 includes a tool body 11 to which a detachable muffler apparatus 12 is removably attached. Thus, the muffler apparatus 12 can be detached from the illustrated wrench 10 and attached to other pneumatic tools of various types in the same manner as the supply tube is exchanged between tools. The muffler apparatus 12 includes a flexible elongated outer housing 13 that includes an attachment end 14 defining a muffler inlet 15 and a distal end 16 defining a muffler outlet 17. The outer housing 13 can be comprised of various flexible materials, including, but not limited to, rubber and plastic. Preferably, housing 13 is simply an elongated segment of a flexible hose with an inner diameter sized to receive supply hose 21 and a suitable amount of flexible permeable material therein. Although the flexible outer housing 13 is preferably tubular and is illustrated as non-permeable, the present disclosure contemplates a permeable outer housing from which some of the tool exhaust can exit, and/or an outer housing of various cross sectional shapes.

A muffler passage 19 extends between the muffler inlet 15 and the muffler outlet 17, and is fluidly connected to exhaust ports 24 (shown in FIG. 2) defined by the tool body 11. The present invention contemplates the outer housing 13 defining multiple muffler passages that may or may not be fluidly connected to one another. An air supply hose 21 includes a tubular housing 20 that is attached to the tool body 11 and defines an air supply passage 22 fluidly connected to an air inlet 23 (shown in FIG. 2) defined by the tool body 11. Preferably, the tubular outer housing 13 of the muffler apparatus 12 concentrically surrounds a portion of the tubular housing 20 of the air supply hose 21. Those skilled in the art should appreciate that the muffler apparatus 12 will always be attached to the tool body 11 at the location of the exhaust ports 24 (shown in FIG. 2). Thus, if the exhaust ports are not adjacent to the air inlet, the flexible outer housing will not concentrically surround the tubular housing of the air hose. The muffler apparatus 12 will be attached to the exhaust part(s) on the tool.

Figure 2:
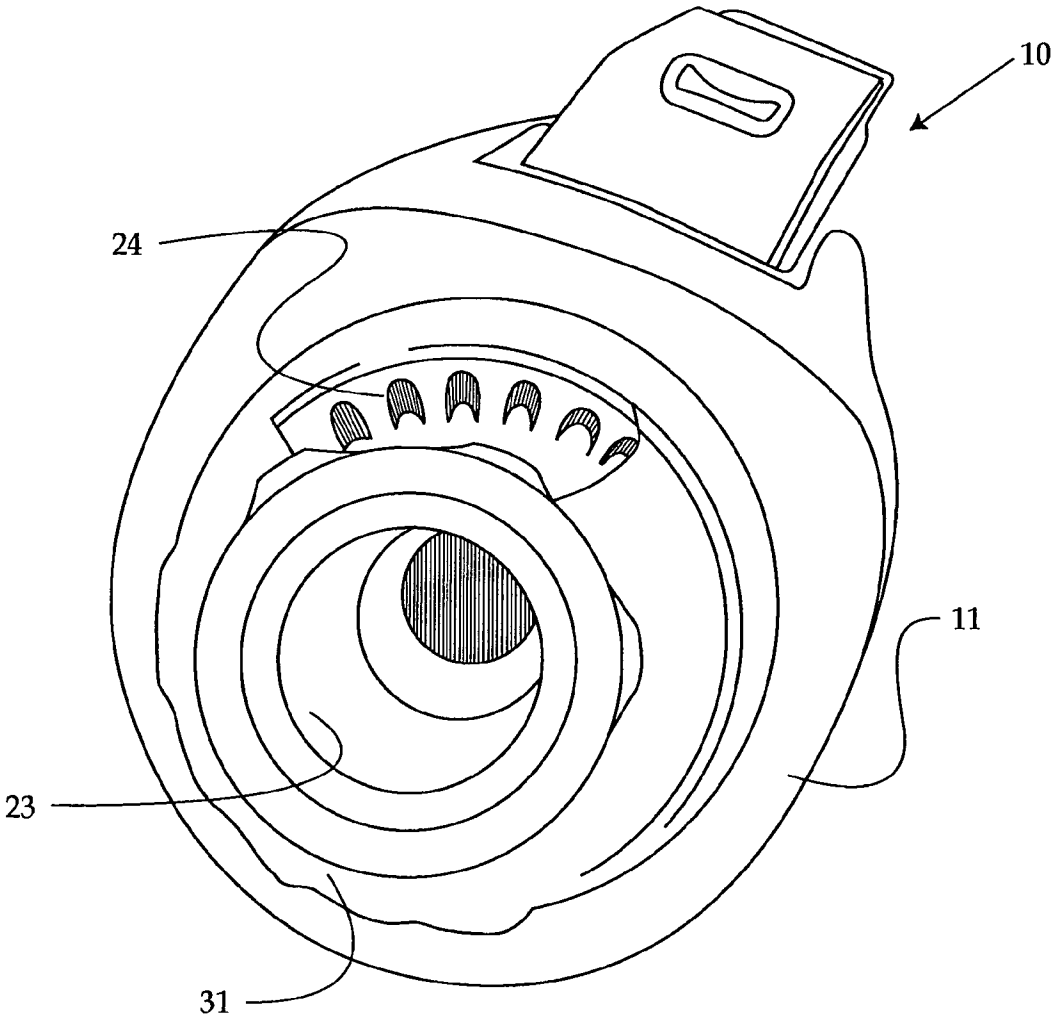
FIG. 2 is an end diagrammatic view of an attachment section of the pneumatic tool of FIG. 1.

Referring to FIG. 2, there is shown an angled view of an attachment section 31 of the pneumatic tool 10 of FIG. 1. The tool body 11 includes the attachment section 31 that defines the air inlet 23 and exhaust ports 24. Although the pneumatic tool 10 is illustrated as including one air inlet 23 and a plurality of exhaust ports 24, the present disclosure contemplates a pneumatic tool including any number of air inlets and exhaust ports. Preferably, the exhaust ports 24 concentrically surround, at least in part, the air inlet 23. However, the present disclosure contemplates pneumatic tools with exhaust port(s) that are not adjacent to or concentrically surrounding the air inlet. In those pneumatic tools, the outer housing of the muffler apparatus will not concentrically surround the air supply hose, but rather be attached to the exhaust part(s) on the tool to dampen the sound.

Figure 3:
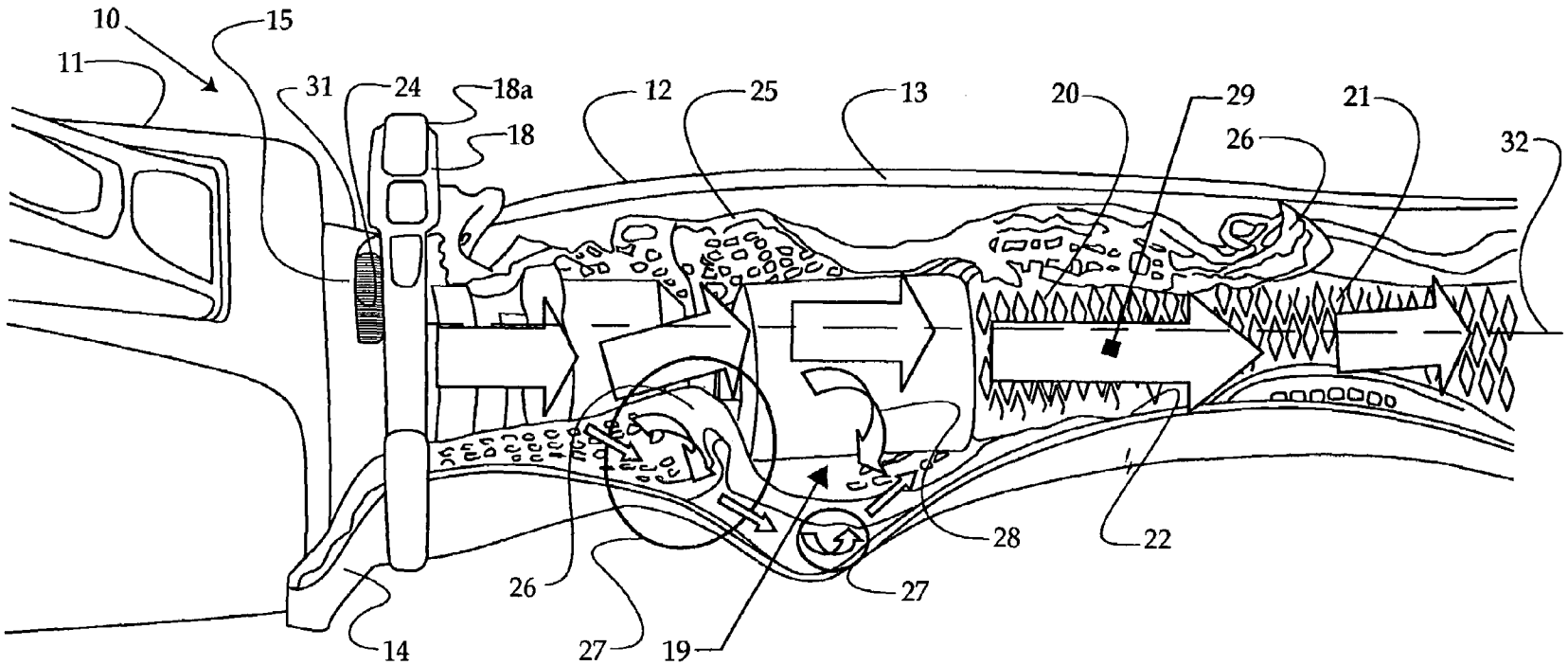
FIG. 3 is partial cross-sectioned diagrammatic view of a muffler apparatus removably attached to the pneumatic tool of FIG. 1.

Referring to FIG. 3, there is shown a partial cross-sectioned view of the muffler apparatus 12 attached to the pneumatic tool 10 of FIG. 1. The attachment end 14 of the flexible outer housing 13 is removably attached to the attachment section 31 of the tool body 11 via a fastener 18 and connects the exhaust ports 24 with the muffler inlet 15. The fastener 18 preferably includes an annular clamp 18*a*, such as the illustrated tie-wrap, that secures the attachment end 14 of the flexible outer housing 13 to the attachment section 31. The attachment end 14 includes a deformable inner diameter such that the attachment end 14 can expand in diameter, if necessary, to fit over the attachment section 31 and/or decrease in diameter when secured to the attachment section 31 with the annular clamp 18*a*. It should be appreciated that the attachment end 14 of the flexible outer housing 13 could be attached to the tool body 11 with various types of fasteners, including, but not limited to, adhesives, screws, hose clamps or the like.

Because the tubular housing 20 of the air hose 21 is preferably concentrically positioned within the flexible outer housing 13 of the muffler apparatus 12, the muffler passage 19 is defined by the flexible outer housing 13 and the tubular housing 20 of the air hose 21. However, in pneumatic tools in which the air inlet is not concentrically surrounded by the exhaust ports, the outer housing the muffler apparatus will not concentrically surround the tubular housing of the air supply hose. Rather, the flexible outer housing of the muffler apparatus will be attached to the tool body at the location of the exhaust ports, and the tubular housing of the air hose will not define, in part, the muffler passage. Thus, the present disclosure contemplates an adapter, if necessary, to facilitate attachment of housing 20 to cover differently located exhaust ports of certain tools. A sheet of permeable material 25 with a plurality of folds 26 is positioned within the muffler passage 19. In the preferred embodiment in which the muffler apparatus 12 concentrically surrounds the air hose 21, the sheet of permeable material 25 is positioned between the inner tubular housing 20 of the air hose 21 and the flexible housing 13 of the muffler apparatus 12. Although the present disclosure is illustrated with one sheet of permeable material 25, there could be various numbers of sheets within the muffler passage 19. Although the permeable material is preferably gauze, the permeable material could include various materials through which exhaust can flow, including but not limited to, woven fabric and natural fibers such as nylon, silk, flax, hemp; woven and non-woven composite fibers; non-woven natural materials such as cotton; woven and non-woven metals or plastics; and shape memory synthetics and alloys. Because the gauze includes a porous weave pattern, the muffler passage 19 includes segments 27 through the sheet of permeable material 25. The gauze can act to diffuse the exhaust passing through the segments 27 of the muffler passage 19. The muffler passage 19 also includes segments 28 around the sheet of permeable material 25. Each fold 26 acts as a baffle which directs the flow of some of the exhaust passing through the muffler passage 19 around the fold 26. Further, some of the exhaust can follow an unobstructed path 29 along the inner wall of tubular housing 20.

The muffler apparatus 12 preferably includes an adjustment feature 30 that permits the adjustment of at least one of a number and size of the folds 26 within the sheet of permeable material 25. In the present illustration, the adjustment feature 30 (shown in FIG. 1) includes the muffler outlet 17 which provides access to the sheet of permeable material 25. The muffler outlet 17 is sized such that the pneumatic tool operator, using his finger or a tool, such as a rod, can apply force to the sheet of permeable material 25 within the housing 13. The operator can compress the sheet of permeable material 25 in order to increase the height and number of folds 26 within the sheet 25. The operator can pull on the sheet of permeable material 25 in order to decrease the size and/or number of folds 26. Any remaining material outside of the muffler apparatus 12 can be tied off or removed. The present disclosure contemplates adjustment features, including but not limited to levers and slides, being operably coupled to the sheet of permeable material 25 in order to adjust the number and size of the folds 26 by compressing and lengthening the sheet of material 25. Moreover, the present disclosure contemplates the sheet of permeable material 25 being coupled to an adjustment feature, including but not limited to, a spring or ring(s), that is positioned along a center axis 32 of the muffler apparatus 12 and around the inner tubular housing 20 of the air hose 21. Force could be applied to move the rings or compress the spring. Specifically, the spring could be attached to a rotating sleeve at the distal end 16 of the housing 13. The sleeve could be rotated in different directions in order to compress and lengthen the sheet of permeable material 25.

Those skilled in the art appreciate that the folds 26 act as baffles around which some of the exhaust must flow. The baffles slow the flow of the exhaust, thereby reducing the sound created by the exhaust. Additional noise reduction is caused by diffusing some of the flow through the gauze 25. Thus, exhaust will be baffled and diffused as it passes through the muffler. Those skilled in the art will appreciate that exhaust flow can be slowed to a point where it creates back pressure within the pneumatic tool 10 that can adversely affect the power of the tool 10. Thus, the number and size of the folds 26 can be adjusted such that the noise created by the exhaust flow is reduced without causing an undesirable pressure increase. The number and size of the folds 26 will vary among types and sizes of pneumatic tools and can be tuned experimentally by the operator. Further, the present disclosure contemplates an adjustment feature that can adjust the amount of diffusion within the muffler apparatus 12. The flow of the exhaust through the pores within the permeable material 25 diffuses the exhaust, thereby slowing the exhaust and reducing noise. The adjustment feature could includes means for adjusting the alignment of a plurality of sheets of permeable material. Diffusion could be increased by misaligning the pores within the sheets of material. As with the baffles, too much diffusion can cause back pressure, leading to a reduction in horsepower. Diffusion could be decrease by aligning the pores within the different sheets of material. Thus, the muffler 12 can be quickly tuned by the operator to suit a particular tool to achieve maximum sound reduction without undermining tool performance.

INDUSTRIAL APPLICABILITY

Referring to FIGS. 1-3, the application of the present disclosure will be discussed for the pneumatic wrench 10, although it should be appreciated that the present disclosure can be applied similarly to various pneumatic tools, including pneumatically exhausted surgical devices. Although the operation of the present invention will be discussed for the muffler apparatus 12 that defines only one muffler passage 19, those skilled in the art will appreciate that the present invention will work similarly in a muffler apparatus defining multiple muffler passages, some of which may further baffle and diffuse the exhaust flow. In order to reduce the sound during operation of the pneumatic tool 10, the muffler apparatus 12 is removably attached to the tool body 11 of the pneumatic tool 10. Preferably, the flexible outer housing 13 is positioned around the air hose 21 such that the attachment end 14 of the outer housing 13 is positioned around the attachment section 13 of the tool body 11. The attachment end 14 can be secured to the attachment section 31 of the tool body 11 by securing the annular clamp 18*a* around the attachment end 14. Once the muffler apparatus 12 is secured to the tool body 11, the exhaust ports 24 are fluidly connected to the muffler passage 19, and the air inlet 23 is fluidly connected to the air hose 21. The sheet of permeable material 25, preferably gauze, is positioned within the muffler passage 19 between the tubular housing 20 of the air hose 21 and the outer housing 13 of the muffler apparatus 12. However, it should be appreciated that if the exhaust ports were located at a position on the tool body other than concentrically surrounding the air inlet, the muffler apparatus 12 would not concentrically surround the air hose 21. The sheet of permeable material 25 is folded in order to create baffles around which some of the exhaust must flow.

As the operator uses the pneumatic tool 10, the exhaust created by the tool 10 passes from the exhaust ports 24 to the muffler passage 19 within the muffler apparatus 12. Because the muffler passage 19 is partially obstructed with the sheet of permeable material 25, the tool exhaust is forced through and around the folds 26 of the sheet 25. The exhaust flowing through the pores within the sheet of permeable material 25 is being diffused, and the exhaust flowing around the folds 26 is being baffled. Both the diffusion and the baffling of the exhaust through and around the sheet of permeable material 25 slows the flow of the exhaust and dampens pressure waves in the exhaust, and thus, lessens the sound created by the exhaust. Further, by directing the exhaust along the tubular housing 20 of the air hose 21, exhaust is being directed away from the operator. However, because the folds 26 within the sheet 25 do not expand the entire height of the muffler passage 19, a portion of the tool exhaust can flow through the unobstructed flow path 29. The portion of the tool exhaust that flows through the unobstructed flow path 29 can be altered by altering the size and/or number of the folds 26.

During operation of the pneumatic tool 10, the operator may find that the sound level created by the exhaust is greater than desired. The operator can adjust or tune the sound by changing the number and size of the folds 26 within the sheet of permeable material 25. After deactivating the pneumatic tool 10, the operator can access the sheet of permeable material 25 with his fingers and/or a tool, such as a thin rod, through the adjustment feature 30, which includes the muffler outlet 17. The operator can then apply force to an end of the sheet of pneumatic material 25 adjacent to the muffler outlet 17, causing the sheet 25 to compress and creating more and/or larger folds 26 within the permeable material 25. The operator can then re-activate the pneumatic tool 10, and determine whether the adjusted number and/or size of folds 26 has adequately reduced the sound production. If the sound has not been adequately reduced, the operator can repeat the process until he or she obtains the desired sound reduction.

During operation of the pneumatic tool 10, the operator may notice that the tool 10 is not operating with the expected horse power. The operator may de-activate the pneumatic tool 10 in order to reduce the number and/or size of the fold 26 acting as baffles. The operator can access the sheet of permeable material 25 with his fingers and/or a tool via the adjustment feature 30, being the muffler outlet 17. By pulling on the sheet of permeable material 25, the operator can lengthen the permeable material 25, thereby reducing the number and/or size of the folds 26 within the sheet 25. Any material 25 remaining outside of the muffler outlet 17 can be secured. When the operator again operates the pneumatic tool 10, there will be less baffling of the exhaust around the folds 26 and a larger unobstructed flow path 29. Thus, the exhaust can move more quickly through the muffler passage 19, thereby reducing, or eliminating, the back pressure within the tool 10 that was causing the reduction in horse power. If the operator feels the tool 10 is still operating with less than the expected power, the operator can repeat the process until the desired operating power is obtained.

The present disclosure is advantageous because the muffler apparatus 12 adds to the health and safety of the pneumatic tool operator. The muffler apparatus 12 reduces sound caused by the operation of the pneumatic tool 10 and directs the exhaust that may contain debris away from the operator while not substantially reducing the horsepower of the tool 10. The sheet of permeable material 25 reduces the noise from the exhaust ports 24 by slowing the flow of the exhaust. The sheet of permeable material 25 acts as a diffuser by forcing some of the exhaust through its pores, and also acts as a baffle by forcing some of the exhaust around the folds 26 within the material 25. Because the outer housing 13 of the muffler apparatus 12 concentrically surrounds a portion of the air hose 21, the muffler apparatus 12 directs the exhaust along the housing 20 of the air hose 21 and away from the operator. In addition, the operator can easily tune the muffler apparatus 12, meaning the operator can adjust the apparatus 12 in order to obtain an increased sound reduction without limiting the operating power of the tool 10.

The present disclosure is further advantageous because the muffler apparatus 12 can be removably attached to various types and sizes of pneumatic tools. The outer housing 13 of the muffler apparatus 12 can form to fit around attachment sections defining exhaust ports of various pneumatic tools. Moreover, the fastener 18, illustrated as the tie-wrap 18*a*, can secure the outer housing 13 to the bodies of various sized pneumatic tools. Preferably, the supply hose 21 and muffler apparatus 10 are easily exchanged between tools via the quick connect coupling of the supply hose 21 and the fastener(s) associated with the muffler apparatus 10. However, those skilled in the art should appreciate that the present disclosure could also apply to muffler apparatuses that are incorporated into the body of the pneumatic tools and are not detachable.

It should be understood that the above description is intended for illustrative purposes only, and is not intended to limit the scope of the present disclosure in any way. Thus, those skilled in the art will appreciate that other aspects, objects, and advantages of the disclosure can be obtained from a study of the drawings, the disclosure and the appended claims.

What is claimed is:

1. A muffler apparatus comprising;

a flexible outer housing defining at least one muffler passage extending between a muffler inlet and a muffler outlet, and including an attachment end defining the muffler inlet and a distal end defining the muffler outlet;

at least one sheet of permeable material with a plurality of folds positioned within the at least one muffler passage;

a fastener being operable to removably attach the attachment end of the outer housing to a body of a pneumatic tool;

an adjustment feature that includes both a number and size of the folds of the at least one sheet of permeable material being adjustable.

2. The muffler apparatus of claim 1 wherein the permeable material includes gauze.

3. The muffler apparatus of claim 1 wherein the outer housing being a permeable tubular housing.

4. The muffler apparatus of claim 3 wherein the fastener includes an annular clamp, and the attachment end includes a deformable inner diameter sized to surround both an inlet and an outlet of the pneumatic tool.

5. The muffler apparatus of claim 4 including an inner non-permeable tubular housing being concentric with the outer housing; and the at least one sheet of permeable material being positioned between the inner non-permeable tubular housing and the outer tubular housing.

6. The muffler apparatus of claim 5 wherein the at least one muffler passage includes segments through and around the sheet of permeable material.

7. A pneumatic tool, comprising:

a tool body defining at least one exhaust port;

a detachable muffler apparatus including a flexible outer housing that includes a distal end defining a muffler outlet and an attachment end defining a muffler inlet, and the attachment end being removably attached to the tool body via a fastener and connecting the exhaust port to the muffler inlet; and at least one flexible sheet of permeable material with a plurality of folds positioned within at least one muffler passage extending between the muffler inlet and the muffler outlet;

an air hose being attached to the tool body and defining an air supply passage being fluidly connected to an air inlet of the tool body;

the air hose being concentrically positioned within the outer housing of the muffler apparatus;

the sheet of permeable material being positioned between the air hose and the outer housing of the muffler apparatus;

wherein the detachable muffler apparatus includes an adjustment feature; and both of a number and size of the folds of the at least one sheet of permeable material being adjustable.

8. The pneumatic tool of claim 7 wherein the permeable material including gauze.

9. The pneumatic tool of claim 7 wherein the outer housing of the muffler apparatus being permeable tubular housing.

10. The pneumatic tool of claim 9 wherein the attachment feature includes an annular clamp, and the attachment end of the outer housing includes a deformable inner diameter sized to surround both the air inlet and the at least one exhaust port of the pneumatic tool.

11. The pneumatic tool of claim 10 wherein the at least one muffler passage includes segments through and around the sheet of permeable material.

12. The pneumatic tool of claim 11 wherein the permeable material includes gauze; and the detachable muffler apparatus includes an adjustment feature, and at least one of a number and size of the folds of the at least one sheet of gauze being adjustable.

13. A method of reducing the sound during operation of a pneumatic tool comprising the steps of:

removably attaching a muffler apparatus to a pneumatic tool body to surround the inlet and outlet with the muffler apparatus;

passing tool exhaust through a muffler passage;

partially obstructing the muffler passage with at least one sheet of permeable material within the muffler apparatus;

forcing the tool exhaust through and around folds within the at least one sheet of permeable material; and adjusting both a number and size of folds of the at least one sheet of permeable material.

14. The method of claim 13 including a step of directing the tool exhaust away from a tool operator, at least in part, by directing the tool exhaust along an outer surface of an air supply hose.

* * * * *